United States Patent [19]

Renaud

[11] 4,102,826

[45] Jul. 25, 1978

[54] LIQUID DETERGENT

[75] Inventor: Jean Renaud, Bougival, France

[73] Assignee: Colgate-Palmolive Company, New York, N.Y.

[21] Appl. No.: 750,097

[22] Filed: Dec. 18, 1976

Related U.S. Application Data

[63] Continuation of Ser. No. 418,288, Nov. 23, 1973, abandoned.

[30] Foreign Application Priority Data

Dec. 6, 1972 [FR] France ..... 72 43324

[51] Int. Cl.[2] ..... C11D 3/26

[52] U.S. Cl. ..... 252/548; 252/545; 252/552; 252/554; 252/DIG. 14

[58] Field of Search ..... 252/548, 545, 554, 552, 252/DIG. 14

[56] References Cited

U.S. PATENT DOCUMENTS

| | | | |
|---|---|---|---|
| 3,676,374 | 7/1972 | Zaki et al. | 252/552 |
| 3,812,042 | 5/1974 | Verdier | 252/552 X |
| 3,819,691 | 6/1974 | Kurkov et al. | 252/554 |

*Primary Examiner*—Mayer Weinblatt

*Attorney, Agent, or Firm*—Richard N. Miller; Murray M. Grill; Herbert S. Sylvester

[57] ABSTRACT

A liquid detergent of the light-duty type, suitable for dishwashing use, is disclosed which contains a $C_{14}$ and/or $C_{15}$ paraffin monosulfonate, most preferably with a supplementary anionic detergent, such as a sulfated ethoxylate of a higher fatty alcohol, and higher fatty acid lower monoalkanolamide, in an aqueous medium. Such liquid detergents, which also contain small proportions of disulfonates corresponding to the monosulfonates, exhibit improved dishwashing and foaming properties, as compared to other paraffin sulfonate-containing detergents.

9 Claims, No Drawings

LIQUID DETERGENT

This is a continuation of application Ser. No. 418,288 filed Nov. 23, 1973, now abandoned.

This invention relates to liquid detergents and to paraffin sulfonate compositions useful as the principal detergent component thereof and which improve the properties of the liquid detergents, especially in dishwashing applications.

Light duty liquid detergents, such as are suitable for use in the washing of dishes, are well known and have met with a high degree of acceptance by consumers because of their good washing and foaming properties and convenient form for use. Most of the formulations in commercial use at the present time are based on synthetic organic detergents which, together with supplementing materials often employed, give them satisfactory detergency and foaming properties. Nevertheless, research continues in an effort to make products that clean and foam even better, produce more stable foams and require less liquid for a particular dishwashing task. As a result of such research the improved compositions of the present invention have been discovered.

In accordance with the present invention a liquid detergent comprises a paraffin monosulfonate detersive component which is a paraffin sulfonate or a mixture of paraffin sulfonates, with the paraffins thereof being of 14 and 15 carbon atoms, in an aqueous medium. In preferred detergent compositions of this type, minor proportions of corresponding paraffin disulfonates are also present, the corresponding paraffin and inorganic sulfate contents are limited, and the paraffin sulfonates are employed in a proportion from 10 to 40% of the liquid detergent, on a 100% active ingredient basis, together with a supplementing water soluble synthetic anionic organic detergent and a foam stabilizer, such as a higher fatty acid lower alkanolamide. In such preferred compositions the aqueous medium is water, although small proportions of solvents and hydrotropes may also be present to aid in the production of clear stable liquids. Also within the invention are methods of washing dishes with such detergents and preferred paraffin sulfonate compositions utilized.

Paraffin sulfonates have previously been employed as anionic detergent constituents of various detergent compositions. Methods for the manufacture of such sulfonates are known in the art and are described in the patent literature. Because of methods of manufacture of the paraffin sulfonates, sometimes called alkane sulfonates, are so well known and because it appears that improved results of the present invention are independent of the manufacturing method, such methods will not be described at length herein. Suffice it to say that all that is usually involved is the reaction of a particular hydrocarbon or hydrocarbon mixture with sulfur dioxide, oxygen and a sulfonation reaction initiator. In variations of this reaction an alkene and a bisulfate may be reacted under the influence of suitable radiation or catalysts. Whatever technique is employed, it normally appears desirable to produce the sulfonate as the monosulfonate, having no unreacted starting hydrocarbon or having a limited proportion thereof present, and with little or no inorganic salt byproduct. Similarly, the proportions of disulfonate or higher sulfonated material will be minimized but some may be present. The monosulfonates may be terminally sulfonated or the sulfonate group may be joined to the A2-carbon or other carbon of the linear chain. Similarly, any accompanying disulfonate, usually produced when an excess of sulfonating agent is present, may have the sulfonate groups distributed over different carbons of the paraffin base and mixtures of the monosulfonates and disulfonates may be present.

When the mixed monoalkane sulfonates wherein the alkane is of 14 and 15 carbon atoms are used in liquid detergents an unexpectedly beneficial improvement in desirable properties thereof has been discovered. Surprisingly enough, this particular mixture, preferably one wherein the ratio of the $C_{14}$ to $C_{15}$ materials is in the range of 1:3 to 3:1, most preferably about 1:2 to 2:1, produces detergents which clean dishes better and which foam longer, especially in hard water, than various other mixtures of the higher paraffin sulfonates, e.g., those of 13 to 17 carbon atoms. This is also true, generally to a lesser exent, of the individual components of the present mixture.

The particular alkane sulfonates or paraffin sulfonates which are components of the present alkane sulfonate compositions are water soluble salts of the corresponding sulfonic acids wherein the salt-forming cation is a solubilizing metal, preferably an alkali metal such as sodium or potassium, or ammonium or lower alkanolammonium, such as triethanolammonium, monoethanolammonium or diisopropanolammonium. The lower alkanol of such alkanolammonium will normally be of 2 to 4 carbon atoms and is preferably ethanol. there may be present with the paraffin monosulfonate a corresponding paraffin disulfonate (thus there will usually be a mixture of the disulfonates in similar proportion to the mixture of $C_{14}$ and $C_{15}$ monosulfonates and generally the salt-forming ions will also be same). Some trisulfonates and higher sulfonates may also be present but usually these will be in such small quantities as to be essentially negligible. Unreacted paraffin and byproduct sulfate, usually a soluble inorganic sulfate such as sodium, potassium or other mentioned sulfate, may be present in measurable quantity, but under usual reaction conditions, they do not appear to significantly adversely influence the compositions. In fact, when 2 to 30% of the disulfonates are present (based upon the weight of monosulfonate), they have a hydrotropic effect.

In the synthetic detergent compositions which are improved by the presence of the $C_{14}$ and $C_{15}$ paraffin sulfonates or mixture there is usually present for its additional detergent effect a supplementary water-soluble synthetic anionic detergent. Such anionic detergents are well known and are described in various texts and encyclopedias in the detergent and chemical arts, such as *Surface Active Agents and Detergents,* Vol. II, by Schwartz, Perry and Berch, (1958, Interscience Publishers, Inc.) and McCutcheon's *Detergents and Emulsifiers Annual* (1969, 1970). Particularly preferred are the alkyl ether sulfates or sulfated ethoxylated higher fatty alcohols of the formula $RO(ETO)_n—SO_3M$, wherein R is a higher alkyl of 10 to 18 carbon atoms, preferably of 12 to 15 carbon atoms and a mix thereof, $n$ is from 2 to 30, preferably from 2.5 to 10 and most preferably about 3, and M is a salt-forming cation, preferably ammonium but also including lower alkylammonium, alkanolamine, alkali metal and other water-soluble salt-forming metals, such as alkaline earth metals and magnesium. If the salt-forming cation is alkylammonium or alkanolamine (alkanolammonium) the alkyl and alkanol groups are of 1 to 4 carbon atoms, preferably of about two carbon atoms. Although it is highly favored to employ the sulfated ethoxylated higher fatty alcohol anionic detergents as the supplementary detergent, other anionics may also be utilized, including: higher alkyl aryl sulfonates, in which the aryl group is preferably phenyl; higher alkyl sulfates; higher fatty acid monoglyceride sulfates; N-higher fatty acyl sarcosides; higher fatty acid N-methyl taurides; higher fatty acid isethionates; and sulfated and sulfonated ethoxylated hydrocarbyl-substituted and unsubstituted phenols. In such compounds the salt-forming ion is the same as previously described for the paraffin sulfonates, the higher alkyls, acyls and fatty acids are of 9 to 18 carbon atoms, preferably 12 to 18 carbon atoms, and the lower alkyls are of 2 to 4 carbon atoms, preferably of two carbon atoms.

The anionic detergents may be further supplemented with minor proportions, generally no more than 15%, of nonionic detergents. Most often the nonionics will be omitted because they sometimes have detrimental effects on foaming power of the product. Nevertheless, they can be used, if desired, and are sometimes employed to decrease the level of foam produced by highly concentrated products. Since nonionic synthetic organic detergents are generally the condensation product of an organic aliphatic or alkyl aromatic hydrophobic compound and hydrophilic ethylene oxide groups. Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

Among the suitable nonionics may be mentioned are the compounds formed by condensing ethylene oxide with a hydrophobic base formed by condensation of propylene oxide with propylene glycol wherein the molecular weight is from 1000 to 15000 and the weight of the hydrophobe is 950 to 4500 (Pluronics$^R$). Heteric condensates of polyoxyethylene and polyoxypropylene on a $C_{1-8}$ alkanol having a hydrophobe molecular weight of at least 1000 and an oxyethylene content of 44–56% by weight are also suitable. Other useful nonionics are the condensates of $C_8$–$C_{18}$ alkanol or $C_6$–$C_{12}$ alkylphenol with 5 to 30 moles of ethylene oxide with ethoxylates of $C_8$–$C_{18}$ fatty acid sorbitan monoesters containing from 5 to 50 ethoxy groups.

A third important constituent of the improved liquid detergents is a foaming agent or foam stabilizer. While this may be of various recognized types, the $C_{10}$–$C_{18}$ alkanoic acid lower alkanolamides perform best with the particular mixed paraffin sulfonates and supplementary detergent of this invention. Preferred alkanolamides are the $C_{12}$–$C_{14}$ alkanoic acid derivatives, wherein the proportion of lauric acid to myristic acid is in the range of 1:3 to 3:1, preferably about 1:1. The lower alkanolamides may be monoalkanolamides or dialkanolamides and usually the alkanol is of 2 to 4 carbon atoms, preferably being ethanol. A most preferred material of this type is lauric myristic monoethanolamide. Such alkanolamides, in addition to aiding and improving the quality, quantity and stability of the foam of the liquid detergent in water, also help to condition the hands of the user of the dishwashing liquid.

The aqueous medium may be water or mixtures of water with either a lower mono- or dihydroxy alcohol containing from 2 to 3 carbon atoms or a lower alkylbenzene sulfonate hydrotrope containing 1 to 3 carbon atoms in the lower alkyl group. The water used is preferably deionized but tap waters of low and medium hardnesses are useful, the hardness preferably being less than 50 p.p.m., as $CaCO_3$. Suitable alcohols include ethanol, isopropanol and propylene glycol. Satisfactory hydrotropes are the sodium, potassium, ammonium and mono- di- and triethanolammonium salts toluene, xylene and cumene sulfonates. Mixtures of alkanols, hydrotropes and alkanols and hydrotropes also may be employed. The alkanols and hydrotropes are usually employed when stable, clear compositions are desired.

Although not required for desired dishwashing and foaming activities, various adjuvants may be employed in the present compositions, usually in small proportions, to impart their special effects. Thickeners or stabilizers such as sodium carboxymethyl cellulose, hydroxypropyl methyl cellulose, carrageenin, alkali metal alginates, gelatin, starches and starch derivatives are useful. Of course, perfumes; dyes and pigments; bactericides; fungicides; buffers (it is normally desired to maintain the pH of the product in the range of 4–9, preferably 5.5–7.5); emollients, e.g., stearic and other fatty acids and "cold cream" ingredients; and inorganic filler salts may be added, although generally the presence of fillers will be avoided. If desired, to produce a heavy duty detergent, larger quantities of silicates and, where permitted, carbonates, nitrilotriacetates and phosphates, e.g., tripolyphosphates, all preferably as the alkali metal, e.g., sodium salts, may be added but normally, for light duty detergent use, these are omitted.

In the paraffin monosulfonates of this invention it is not necessary to have present any corresponding more highly sulfonated paraffins but normally from 2 to 30%, preferably 5 to 15%, by weight based upon the weight of monosulfonates, will be present, as byproducts of the sulfonation. Similarly, although from 0 to 15% of the corresponding paraffinic starting materials may be tolerated, there will normally be present from 0 to 5% thereof and the proportion of sodium sulfate or other sulfate byproduct will normally be held below 5%, when feasible. In the present specification and claims the term "paraffin sulfonate" is employed to designate the monosulfonates and the mixture thereof, although they may have present in them some di- and higher sulfonated compounds.

The liquid detergent, to have the desired foaming and cleansing effects on dishes and other utensils coated with normal food particles, greases, proteins, starches and gums, dyes, oils, burnt organics etc., will generally contain from 10 to 40% of the mentioned paraffin sulfonate mixture of individual components, on an active ingredient basis, and will contain no other paraffin monosulfonates in detrimental or significant quantities. If such other materials are present, they diminish the foaming and detergency of the composition. Within the 10 to 40% range it is preferred that 15 to 35% of the monosulfonates be present in the described mixture. A supplementary water-soluble synthetic anionic organic detergent may constitute from 5 to 20% of the liquid detergent, and 1 to 10% thereof may be a water-soluble foaming agent or stabilizer, such as lauric myristic monoethanolamide. The balance, which may include 40 to 80% of water, may also include various adjuvants, usually totalling no more than 20% and preferably no more than 10%. To make clear stable products one may use 2 to 6% of hydrotrope, preferably sodium xylene sulfonate, and 4 to 10% of solvent, preferably ethanol.

A preferred composition will contain by weight 15 to 30% of the paraffin monosulfonates in a mixture wherein the ratio of the 14 and 15 carbon atoms compounds is between 1:2 and 2:1, to 15% of a water-soluble salt of a sulfated ethoxylated $C_{12}$–$C_{15}$ alcohol in which containing from 2 to 30 moles of ethylene oxide; 2 to 10% of higher fatty acids lower monoethanolamide; and 40 to 75% of water. Such a composition may include 0.3 to 4.5, preferably 0.7 to 2.3%, of sodium paraffin disulfonates or equivalent soluble disulfonate salts. A much preferred composition includes 15 to 30% of the paraffin monosulfonate mixture, 0.3 to 4.5% of corresponding sodium paraffin disulfonates, 7 to 15% of the ammonium salt of a sulfated ethoxylated $C_{12}$–$C_{15}$ alcohol containing three moles of ethylene oxide, 2 to 5% of lauric-myristic fatty acids monoethanolamide, 3 to 5% of sodium xylene sulfonate, 4 to 8% ethanol and 40 to 70% of water. In such a composition it is preferred that the paraffin monosulfonates and paraffin disulfonates should each be completely or at least substantially free (containing less than 10%, preferably less than 5% and most preferably less than 2%) of such sulfonates of other carbon atoms contents. Best foaming and cleaning are obtained in the substantial absence of such other materials. It is also preferred that the disulfonates each be in about a 2:1 ratio with respect to those of 14 and 15 carbon atoms and the proportion of sodium paraffin monosulfonates to ammonium salt of higher fatty alcohol ethoxylate sulfate should be about 1:1 to 2:1.

To make the present compositions is a simple matter, it being usual merely to mix the various components in the aqueous medium, preferably with stirring at an elevated temperature, e.g., 40 °–50° C., for a short period of time, e.g., five minutes. Order of addition is not of importance except for the final addition of the monoethanolamide although it is preferred to add the alkane sulfonate to the water, followed by the fatty alcohol ethoxylate sulfate, hydrotrope and solvent (if the temperature is low enough to avoid excessive volatilizing) and the melted monoethanolamide. After manufacture, the product may be bottled, packed, cooled, stored and shipped for use.

The improved liquid dishwashing detergent may be employed in a manner similar to that used with other such products now on the market. The difference is in the results obtained rather than in the method of use. The concentration of the liquid detergent in wash water will be from 0.02 to 0.3% by weight, preferably 0.03 to 0.2%. Unexpectedly beneficial results are obtained when the present dishwashing detergent is utilized in hard water, such as that having a hardness of 100 to 500 parts per million as $CaCO_3$, preferably of 100 to 300 p.p.m. In use, such water is elevated to a temperature of about 40° to 60° C., the detergent is added and the dishes, pots and utensils are washed with it. The pH of the wash water will normally be from 4 to 9, preferably from 5.5 to 7.5 and during the period of washing, which may take from one minute to one-half hour, a stable copious foam of desirable consistency and appearance is obtained and the dishes washed are washed clean. In laboratory tests, which duplicate or simulate actual wash conditions, and in actual home dishwashing it is found that the foaming ability of the present compositions and their washing power (number of plates washed before foam disappears) are superior to those of various other individual components of the alkane monosulfonate mixes and of other alkane monosulfonates of different carbon contents. Such a discovery was unpredictable and has led to a significant improvement in properties of liquid detergents and the basic synthetic anionic detergent mixtures used in their manufacture, at little extra expense and without need for further screening of new chemical compounds for toxicity, biodegradability, etc. Now it is possible to make the desired product by regulating the composition of the paraffin to be sulfonated. Furthermore, the present compositions have the advantage that the improved alkane sulfonates thereof are more readily biodegradable than many other commercial anionic detergents which are suitable for the manufacture of liquid dishwashing compositions.

The following examples illustrate but do not limit the invention. Unless otherwise indicated, all temperatures are in ° C. and all parts are by weight.

Example 1

| | Percent |
|---|---|
| * Sodium paraffin sulfonate | 22 |
| ** Ammonium higher alcohol ethoxylate sulfate | 13 |
| Lauric myristic monoethanolamide | 5 |
| Perfume | 0.1 |
| Dye | 0.01 |
| Sodium xylene sulfonate | 4.0 |
| Water, deionized | 50.4 |
| Ethyl alcohol | 5.5 |

* Mixed n-alkane monosulfonates of $C_{14}$ and $C_{15}$ chain lengths in approximately 2:1 ratio, including about 8% thereof of corresponding disulfonates, 3% thereof of corresponding unreacted paraffins and 5% thereof of sodium sulfate.
**Ammonium salt of sulfuric acid derivative of triethoxylated higher fatty alcohol of mixed 12–15 carbon atoms (approximately equal mixture).

The above liquid detergent is made by dissolving the mixed $C_{14}$–$C_{15}$ paraffin sulfonate accompanied by the disulfonates, paraffins and sodium sulfate, in the water at a temperature of about 50° C., after which there are added to the solution the ammonium higher alcohol ethoxylate sulfate, sodium xylene sulfonate, melted lauric myristic monoethanolamide, ethyl alcohol and adjuvants, and the mix is stirred for about 5 minutes, untill all the constituents thereof are dissolved. The product is a clear solution with a pH of about 7. If the pH becomes too high citric acid, gluconic acid, boric acid or other suitable buffer-forming material is added to lower it to the desired range of 4–9, preferably 5.5–7.5. The mixed n-alkane monosulfonates utilized are obtained from Texaco Corporation mixed alkane, sulfonated in normal manner by Societe Nationale des Petroles d'Aguitaine (SNPA) and are in the form of a pale yellow translucent paste having an active ingredient content of about 63% monosulfonates and about 8% of the corresponding disulfonates, with a specific gravity of about 1.0 and a pH of about 7–8 in 1% solution. Their aerobic biodegradability according to the Institute National de Recherche de Chemie Appliquee (IRCHA) test (basis for French legislation) is about 99+%.

The above liquid dishwashing detergent is employed in the normal manner to wash a mixture of dishes, pots and utensils containing food particles, proteins, fats and oils and burnt-on materials and is found to be superior in washing and foaming ability to commercial products. Products containing such mixture and products based on the individual monosulfonate components are also superior to dishwashing compositions of similar formulations but based on other individual $C_{10}$–$C_{19}$ alkane sulfonates, and to various mixtures thereof, including mixtures of $C_{14}$–$C_{16}$ and $C_{13}$–$C_{17}$ products. Such results are verified by laboratory tests, including the Ross-Miles foam test and the "miniplate dishwashing test."

The compositions based on the present mixtures are even better in foaming than those based on their separate alkane sulfonates, especially at 0.15% product concentration in hard water.

Whereas the actual dishwashing tests are conducted at a temperature of about 50° C. and a concentration of 0.2% in wash water at hardnesses of 50 p.p.m., as $CaCO_3$, and 300 p.p.m., and are run over periods of 20 minutes, the laboratory tests are at somewhat different standardized conditions. Thus, the Ross-Miles test measures the level of foam in a graduate after 30 seconds, utilizing 0.03% of the liquid detergent at 50 p.p.m. and 0.05% at 300 p.p.m. At 50 p.p.m. the foaming of the mixture is significantly better than that of similar detergent compositions based on monosulfonates of $C_{10}$–$C_{13}$, $C_{13}$–$C_{17}$, $C_{14}$–$C_{17}$, $C_{16}$–$C_{18}$ and $C_{16}$–$C_{19}$ cuts and is better than that found when $C_{14}$, $C_{16}$ and $C_{17}$ individual monosulfonates are employed in the liquid detergent. Approximately the same effect is obtained with the single $C_{15}$ cut monosulfonate. In 300 p.p.m. hardness water the foaming of the $C_{14}$–$C_{15}$ mix product is superior to all other liquid detergents mentioned. The tests run are at 40° C. which is comparable to actual conditions.

In the "miniplate" test of such materials small plates having a standard amount of a standard grease coating applied thereto are washed in warm water, e.g., at 45° C. at the beginning of the test, at different hardnesses and with different concentrations of liquid detergent and the numbers of plates washed until the foam disappears are counted. Utilizing the same liquid detergent as previously mentioned it is found that in 50 p.p.m. hardness water with 0.15% of liquid detergent, 59 plates are washed with the experimental composition of this invention and fewer plates are washed with all other compositions, only the $C_{14}$, $C_{15}$, and $C_{16}$ products even being close in washing ability. At 300 p.p.m. the differences become even more significant, with the experimental formulation washing 64 plates whereas the closest in such washing ability of the other detergents are those based on single $C_{14}$ and $C_{15}$ component paraffin sulfonates. At lower concentrations of the liquid detergent the present mixed paraffin sulfonates are superior to other such mixtures and are better than some formulations based on individual monosulfonates and almost as good as others.

From the above tests it is apparent that the $C_{14}$–$C_{15}$ mix of paraffin sulfonates results in a superior liquid detergent with respect to dishwashing and foaming properties. It is noted that the compositions are as mild to the hands as commercial liquid detergents and the other paraffin sulfonate-based compositions tested.

When the foregoing paraffin sulfonate mixture is replaced by those of other manufacturers, essentially the same results are obtained. Similarly, when the sulfonations are effected by the Hoechst method, instead of that of SNPA, used in the above tests, a similar superiority is obtainable. Such results are also obtained when the sodium sulfate content is varied from 0 to 20% and when the unsulfonated oil content is in the 0 to 15% range, although in both cases best effects are obtained at lower concentrations thereof, e.g., 0–5%.

EXAMPLE 2

The procedures of Example 1 are followed, utilizing a different formulation in which there is present 30% of the paraffin sulfonate of example 1, 8% of the ammonium salt of the lauryl triethoxy sulfuric acid and 2% of lauric myristic monoethanolamide, the balance being water. In a test of miniplate washing ability, at the concentrations previously mentioned, the $C_{14}$–$C_{15}$ monosulfonate-based mixture is found superior to one of mixed $C_{14}$–$C_{17}$ monosulfonates and similar results are obtained at 0.03% and 0.05% concentrations at 50 p.p.m. and 300 p.p.m. respectively, in the Ross-Miles foam test. It is noted that the superiority is greatest at the higher hardnesses, e.g., 300 p.p.m.

Essentially similar results are obtainable when lauric myristic monoethanolamide is replaced by other foam stabilizers, including lauric diethanolamide, and when thickeners such as sodium carboxymethyl cellulose are present in small quantities, e.g., 1%. This is also the case when, instead of the lauryl ethoxylate sulfate, other synthetic organic detergents such as sodium coconut oil fatty acids monoglyceride sulfate, ammonium lauryl alcohol sulfate, triethanolamine lauryl sulfate or sodium N-lauroyl sarcoside are substituted for at least a part thereof, e.g., 25 to 50% thereof. Such is also true when potassium, ammonium or triethanolamine salts of the paraffin sulfonic acids are used instead of the sodium salts. Overall best results are obtained in waters of about 100 – 300 p.p.m. $CaCO_3$ hardness.

EXAMPLE 3

The experiments of Example 2 are repeated with another formulation in which the ratio of paraffin sulfonate to ethoxylate sulfate is about 4 to 1, in which there are present 26% of the paraffin sulfonate, 7% of the ethoxylate sulfate and 2% of the amide, all such materials being the same as those of Example 2. Again, in both the miniplate washing and foam tests described in Example 2 the "experimental" products of this invention excel, especially in the harder water. The superiorities of the mixtures of $C_{14}$ and $C_{15}$ paraffin sulfonates and the individual components are also shown in like manner.

This invention has been described with respect to specific working examples but is not to be limited to these nor to the materials or methods specifically mentioned in the disclosure because one of skill in the art will be able to utilize substitutes or equivalents without departing from the scope and spirit of the invention.

What is claimed is:

1. A liquid detergent composition consisting essentially of 10% to 40% by weight of a water-soluble paraffin monosulfonate salt wherein the paraffin is a mixture of 14 carbon atoms and and 15 carbon atoms in a weight ratio of $C_{14}$ monosulfonate to $C_{15}$ monosulfonate of from 1:3 to 3:1 and the salt forming ion is selected from the group consisting of sodium, potassium, ammonium and $C_2$–$C_4$ alkanolammonium, 2 to 30% by weight of a corresponding water-soluble salt of a disulfonate of said paraffin mixture, 0 to 15% by weight of said paraffin mixture and 0 to 20% by weight of a corresponding water-soluble salt of an inorganic sulfate, the weight proportions of said disulfonate salt, said paraffin and said sulfate salt being based upon the weight of said monosulfonate salt, solubilized in an aqueous medium, said paraffin monosulfonate being the principal detergent component and said composition containing no significant quantities of paraffin monosulfonate of other carbon contents.

2. A liquid detergent according to claim 1 wherein said paraffin monosulfonate, said paraffin disulfonate and said sulfate are sodium salts and the proportion of said paraffin monosulfonate present is from 15 to 35% by weight.

3. A liquid detergent according to claim 1 which further includes 5 to 20% by weight of a supplementary, water-soluble, synthetic, anionic, organic detergent salt selected from the group consisting of $C_{10}$–$C_{18}$ alkyl ethenoxy ether sulfates having 2 to 30 ethylene oxide groups, $C_9$–$C_{18}$ alkyl phenyl sulfonates, $C_9$–$C_{18}$ acyl monoglyceride sulfates, N-$C_9$–$C_{18}$ acyl sarcosides, N-$C_9$–$C_{18}$ acyl-N-methyl taurides, N-$C_9$–$C_{18}$ acyl isethionates and $C_9$–$C_{18}$ alkyl phenol ethenoxy sulfates or sulfonates, said salt-forming ion being selected from the group consisting of $C_1$–$C_4$ alkylammonium, $C_1$–$C_4$ alkanolammonium, ammonium and alkali metal, and 1 to 10% by weight of a $C_{10}$–$C_{18}$ alkanoic acid $C_2$–$C_4$ alkanolamide faom stabilizer and wherein the aqueous medium contains 40 to 80% by weight of water.

4. A liquid detergent according to claim 3 wherein said mixture of paraffin monosulfonates is from 15 to 35% by weight and said supplementary synthetic anionic organic detergent is a water-soluble salt of a sulfated ethoxylated $C_{10}$–$C_{18}$ alcohol having from 2 to 30 ethylene oxide groups.

5. A liquid detergent according to claim 4 in which said paraffin disulfonate is present in an amount of 0.3 to 4.5% by weight of the mixture of said monosulfonate and said water-soluble salt of a sulfated ethoxylated higher fatty alcohol has 12 to 15 carbon atoms in the alcohol group and is present in an amount of 5 to 15% by weight.

6. A clear liquid detergent according to claim 5 wherein said aqueous medium is selected from the group consisting of water, a mixture of water and $C_2$–$C_3$ alkanol, a mixture of water and $C_1$–$C_3$ alkyl substituted benzene sulfonate and a mixture of water, said alkanol and said alkyl-substituted benzene sulfonate.

7. A liquid detergent according to claim 6 wherein said monoethanolamide is lauric-myristic monoethanolamide and is present in an amount of 2 to 5% by weight and said aqueous medium contains 3 to 5% by weight of sodium xylene sulfonate and 4 to 8% by weight of ethanol.

8. A method of washing dishes in water having a hardness of 100 to 500 parts per million, as $CaCO_3$, comprising mixing with such hard water from 0.02 to 0.3% by weight of the liquid dishwashing detergent of claim 1 and washing said dishes.

9. A method of washing dishes as set forth in claim 8 wherein said liquid detergent further includes 5 to 20% by weight of a supplementary water-soluble synthetic anionic organic detergent, 1 to 10% by weight of a $C_{10}$–$C_{18}$ alkanoic acid $C_2$–$C_4$ alkanolamide foam stabilizer and 40 to 80% of water.

* * * * *